US009482977B2

(12) United States Patent
Obara et al.

(10) Patent No.: US 9,482,977 B2
(45) Date of Patent: Nov. 1, 2016

(54) TWO-COMPONENT DEVELOPER

(71) Applicant: Konica Minolta, Inc., Tokyo (JP)

(72) Inventors: Shinya Obara, Tokyo (JP); Satoshi Uchino, Tokyo (JP); Kosuke Nakamura, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/990,409

(22) Filed: Jan. 7, 2016

(65) Prior Publication Data

US 2016/0202625 A1 Jul. 14, 2016

(30) Foreign Application Priority Data

Jan. 9, 2015 (JP) ..... 2015-003500

(51) Int. Cl.

| | |
|---|---|
| ***G03G 9/107*** | (2006.01) |
| ***G03G 9/113*** | (2006.01) |
| ***G03G 9/08*** | (2006.01) |

(52) U.S. Cl.

CPC ..... *G03G 9/1132* (2013.01); *G03G 9/0819* (2013.01); *G03G 9/0827* (2013.01)

(58) Field of Classification Search

CPC ..... G03G 9/107

See application file for complete search history.

(56) References Cited

U.S. PATENT DOCUMENTS

2009/0197190 A1* 8/2009 Nakamura ..... G03G 9/081 430/48

FOREIGN PATENT DOCUMENTS

| | | |
|---|---|---|
| JP | 2000338719 A | 12/2000 |
| JP | 2001330996 A | 11/2001 |

* cited by examiner

*Primary Examiner* — Hoa V Le

(74) *Attorney, Agent, or Firm* — Lucas & Mercanti, LLP

(57) ABSTRACT

Disclosed is a two-component developer containing toner particles and carrier particles. The number-average particle diameter of the toner particles MDt ranges from 3.5 to 5.0 μm. The MDt of the toner particles and the volume-average particle diameter of the carrier particles MDc are at a specific ratio, and spherical fine toner particles in the toner particles and fine carrier particles in the carrier particles exist at specific percentages.

6 Claims, 1 Drawing Sheet

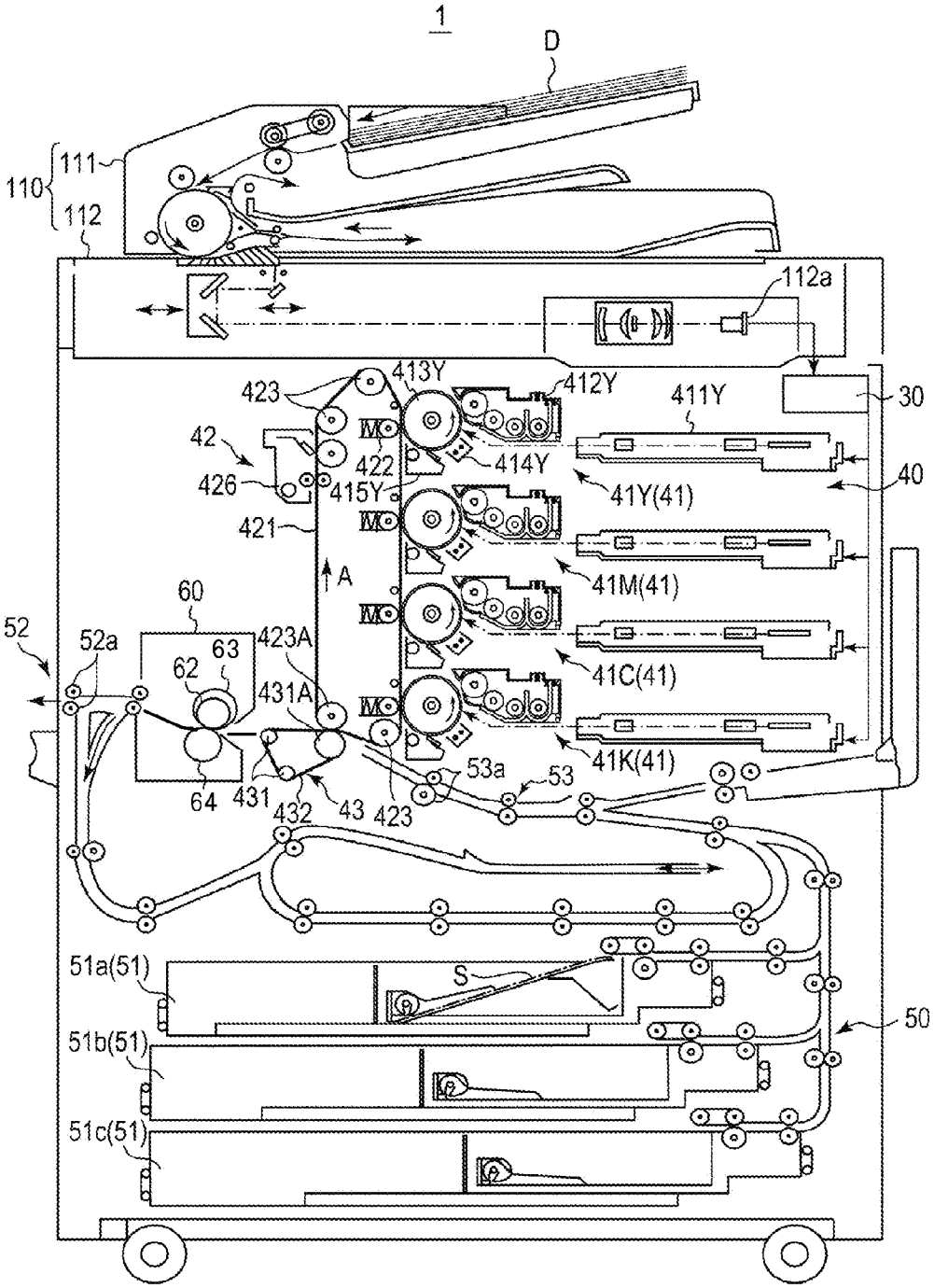
1
D
110
111
112
112a
30
423
413Y
412Y
411Y
42
422
414Y
426
415Y
41Y(41)
40
421
A
41M(41)
60
52
52a
63
423A
62
41C(41)
431A
41K(41)
53a
53
64
431
432
43
423
51a(51)
S
50
51b(51)
51c(51)

TWO-COMPONENT DEVELOPER

CROSS REFERENCE TO RELATED APPLICATIONS

This application is entitled to and claims the benefit of Japanese Patent Application No. 2015-003500 filed on Jan. 9, 2015, the disclosure of which including the specification, drawings and abstract is incorporated herein by reference in its entirety.

BACKGROUND OF THE INVENTION

1. Field of the Invention

The present invention relates to two-component developers for developing electrostatic latent images.

2. Description of Related Art

Formation of color images by the electrophotographic process generally involves the use of two-component developers that contain toner particles containing a colorant, and carrier particles for stirring and conveying the toner particles. With the spread of digital printing, for example, high-quality images and stable image formation have been increasingly required. To that end, methods have been studied from the viewpoint of energy saving, e.g., lowering the melt temperature or melt viscosity of the binder resin of toner particles for reduced energy required for the fixation of toner images on paper, reducing the amount of toner particles on paper for reduced energy required for the fixation of toner images, and so forth.

As for the latter method (i.e., reducing the amount of toner particles on paper), it has been considered to reduce the particle diameter of toner particles. By making toner particles smaller, the surface area of the toner particles is increased, and thus it becomes possible to cover paper (i.e., form an image) with a less amount of toner particles. As a result, it becomes possible to reduce energy required for the fixation without lowering image density. Further, smaller toner particles can well reproduce fine latent images, and thus achievement of both energy saving and formation of high-quality images is expected.

Examples of known two-component developers include those in which the number-average particle diameter of toner particles is specified, and those in which the number-average particle diameter and weight-average particle diameter of toner particles are specified and the shape of toner particles is specified by shape factor (see, e.g., Japanese Patent Application Laid-Open Nos. 2000-338719 and 2001-330996).

SUMMARY OF THE INVENTION

However, when toner particles are made smaller, the number of contact points between the toner particles and carrier particles is increased. Therefore, the flow ability of the two-component developer becomes insufficient causing toner-spent to easily occur, a phenomenon where the toner particles attach to, and thus stain, the carrier particles. As a result, problems occur, such as uneven electric charge amount of toner particles, uneven conveyance amount of toner particles by carrier particles during developing, and uneven magnetic brush formation. These problems may make stable formation of high-quality images difficult.

The two-component developers disclosed in Japanese Patent Application Laid-Open Nos. 2000-338719 and 2001-330996 leave room for consideration of the toner-spent problem caused by downsizing toner particles.

An object of the present invention is to provide a two-component developer capable of maintaining high flow ability and of suppressing the occurrence of toner-spent even when smaller toner particles are used.

Solution to Problem

The present invention provides a two-component developer for developing an electrostatic latent image, wherein the two-component developer contains toner particles and carrier particles, wherein a number-average particle diameter MDt of the toner particles ranges from 3.5 to 5.0 μm, and wherein the two-component developer satisfies the following Formulas 1 and 2:

$$4.5 \leq MDc/MDt \leq 6.5 \quad \text{Formula 1}$$

$$(2/5)X+Y \leq 20 \text{ (with the proviso that } 10 \leq X \leq 40) \quad \text{Formula 2}$$

where "MDc" represents a volume-average particle diameter of the carrier particles, "X" represents a proportion (%) of toner particles having a number distribution-based particle diameter of 3.0 μm or more to less than 4.5 μm and a circularity of 0.980 or more in the total of the toner particles, and "Y" represents a proportion (%) of carrier particles having a volume distribution-based particle diameter of (2/3)×MDc or less in the total of the carrier particles.

Advantageous Effects of Invention

A two-component developer according to an embodiment of the present invention is capable of maintaining high flow ability and suppressing the occurrence of toner-spent even when using smaller toner particles. As a result, it becomes possible to form high-quality images stably for a long period of time by using the two-component developer in an imaging forming method by the electrophotographic process.

BRIEF DESCRIPTION OF DRAWINGS

The present invention will become more fully understood from the detailed description given hereinbelow and the appended drawings which are given by way of illustration only, and thus are not intended as a definition of the limits of the present invention, and wherein:

FIG. 1 schematically illustrates a configuration of an example of an image forming apparatus in which a two-component developer according to an embodiment of the present invention is used.

DESCRIPTION OF THE PREFERRED EMBODIMENTS

It is effective to further increase the average circularity of toner particles in a two-component developer, from the viewpoint of increasing the flow ability of the two-component developer. However, an increase in the average circularity of relatively small toner particles may increase the number of fine toner particles having small particle diameters and high circularities. Due to their small diameter and high circularity, these spherical fine toner particles contact or collide with carrier particles highly frequently during mixing with the carrier particles, leading to toner-spent.

The same holds true for the particle diameter of carrier particles. Specifically, carrier particles having smaller particle diameters contact or collide with toner particles highly frequently compared to carrier particles having larger particle diameters, and thus toner-spent is likely to occur.

Further, when the particle diameter of carrier particles is made excessively large compared to the toner particles, the flow ability of the two-component developer increases, but the collision force of the carrier particles with toner particles becomes strong, resulting in cracks or chips in the toner particles. As a result, toner-spent may occur.

In view of the foregoing, the present invention specifies a proper relationship of particle diameter between toner particles and carrier particles in Formula 1 and, in order to prevent toner-spent, specifies a proper relationship between the percentage of the spherical fine toner particles and the percentage of the fine carrier particles in Formula 2. Thus, a two-component developer is provided which has high flow ability characteristics and is capable of preventing toner-spent.

Embodiments of the present invention will now be described.

A two-component developer according to an embodiment of the present invention is a two-component developer for developing an electrostatic latent image and contains tonner particles and carrier particles. The two-component developer can be produced in a manner similar to that for typical two-component developers except that toner particles and carrier particles described below are used. For example, the two-component developer can be produced by appropriately mixing the toner particles and carrier particles such that the toner particle content (toner concentration) in the two-component developer is 4.0 to 8.0 mass %.

The number-average particle diameter MDt of the toner particles ranges from 3.5 to 5.0 μm. When MDt is less than 3.5 μm, the flow ability of the toner particles in the two-component developer may be lowered; for example, mixing of the toner particles and the carrier particles during continuous printing becomes insufficient, which may result in insufficient image quality (e.g., poor in terms of grainy feeling of an image) due to uneven electric charge of the toner particles. When MDt is more than 5.0 μm, for example, image fineness may become insufficient resulting in insufficient image quality.

MDt is a number-average particle diameter of toner particles, and may be either a median diameter (D50t) or a mode diameter, when the particle size distribution of the toner particles is at least substantially a normal distribution.

The number-average particle diameter of toner particles can be measured and calculated using an apparatus in which a data processing computer system is connected to "Multisizer 3" (manufactured by Beckman Coulter, Inc.). In the measurement procedure, for example, 0.02 g of toner particles is wetted with 20 mL of a surfactant solution, followed by ultrasonic dispersion for 1 minute to produce a toner particle dispersion liquid in which the toner particles are dispersed. The surfactant solution is, for example, a solution obtained by 10-fold dilution of a neutral detergent including a surfactant component with pure water.

The toner particle dispersion liquid is injected into a beaker containing ISOTON II (manufactured by Beckman Coulter, Inc.) in a sample stand, with a pipette, until the concentration of the toner particles reaches 5 to 10%, and measurement is made with the measuring device count set to 25,000. It is noted that the aperture diameter of Multisizer 3 is set at 100 μm. The measurement range ranging from 1 to 30 μm is divided into 256 segments and the frequency is calculated for each segment. When MDt is a median diameter, the particle diameter at which the cumulative number percent from the larger particle-size side reaches 50% is determined as the number-average particle diameter (D50t).

MDt can be adjusted for example by the temperature and stirring condition during the production of toner particles, classification of toner particles, or mixing of classified products of toner particles.

The two-component developer satisfies the following Formulas 1 and 2:

$$4.5 \leq MDc/MDt \leq 6.5 \quad \text{Formula 1}$$

$$(2/5)X+Y \leq 20 \text{ (with the proviso that } 10 \leq X \leq 40) \quad \text{Formula 2}$$

In Formula 1, MDc represents a volume-average particle diameter of carrier particles. In Formula 2, X represents a proportion (%) of the toner particles having a number distribution-based particle diameter of 3.0 μm or more to less than 4.5 μm and a circularity of 0.980 or more (hereinafter, also referred to as "spherical fine toner particles") in the total of the toner particles, and Y represents a proportion (%) of the carrier particles having a volume distribution-based particle diameter of (2/3)×MDc or less (hereinafter, also referred to as "fine carrier particles") in the total of the carrier particles.

When the ratio of the volume-average particle diameter of carrier particles to the number-average particle diameter of toner particles, (MDc/MDt), is less than 4.5, the contact points between the toner particles and the carrier particles in the two-component developer are increased, and as a result, for example, the flow ability of the two-component developer is lowered, causing irregular conveyance of the two-component developer to occur during developing, which may cause the image quality to be insufficient. Further, when the MDc/MDt is more than 6.5, the carrier particles become excessively large, resulting in for example the occurrence of crack or chip of toner particles due to collision of the carrier particles with the toner particles, causing toner-spent to occur, thus leading to uneven electric charge of toner particles, which may cause the image quality to be insufficient.

MDc is a volume-average particle diameter of the carrier particles, and may be either a median diameter (D50c) or a mode diameter, when the particle size distribution of the carrier particles is at least substantially a normal distribution.

The volume-average particle diameter of the carrier particles is measured by a wet process using a laser diffraction particle size analyzer "HELOS KA" (manufactured by Japan Laser Corporation). For example, an optical system with a focal position of 200 mm is first selected, and the measuring time is set at 5 seconds. Then, carrier particles for measurement are added to 0.2% aqueous sodium dodecyl sulfate solution and dispersed for 3 minutes using an ultrasonic cleaner "US-1" (manufactured by AS ONE Corporation) to produce a sample dispersion liquid for measurement. A few drops of the sample dispersion liquid are supplied to "HELOS KA," and measurement is initiated at a time point when a sample concentration gauge reaches a measurable range. The resultant particle size distribution is used to prepare a cumulative distribution from the smaller particle-size side for a particle size range (channel). When MDc is a median diameter, the particle diameter at which the cumulative number percent reaches 50% is determined as the volume-average particle diameter (D50t).

MDc can be adjusted according to a method in which the particle diameter of core material particles is controlled by conditions for producing the core material particles, classification of carrier particles, mixing of classified products of carrier particles, and the like.

In the case where the sum of (2/5)X and Y is more than 20 when X ranges from 10 to 40, both the fine carrier particles and the spherical fine toner particles being likely to cause toner-spent are present in large amounts in the two-component developer, and as a result, for example, toner-spent is more likely to occur, leading to uneven electric charge of toner particles, which may cause the image quality to be insufficient.

X can be determined by measuring the circularity and particle diameter of toner particles concurrently using a flow type particle image analyzer mentioned below and calculating the ratio (number %) of toner particles that satisfy both the conditions of particle diameter range (3.0 μm or more to less than 4.5 μm) and of circularity range (0.980 or more) to all the toner particles. Further, X can be adjusted according to a method similar to the above-described method for adjusting MDt.

The circularity of toner particles can be measured using a flow type particle image analyzer "FPIA-3000" (manufactured by Sysmex Corporation). Specifically, the toner particles are wetted with an aqueous surfactant solution, and are dispersed via ultrasonic dispersion for 1 minute, followed by measuring with "FPIA-3000" in an HPF (high magnification imaging) mode at an appropriate concentration of the HPF detection number of 3,000 to 10,000 as a measuring condition. This method is preferred from the viewpoint of obtaining reproducible measurement values. The circularity of the toner particles is calculated according to the following Formula:

Circularity=(circumference length of a circle having a projection area equal to that of a particle image)/(circumference length of the projection of the particle)

The average circularity of toner particles is an arithmetic average value obtained by summing the circularities of the respective particles and dividing the sum by the total number of the measured particles.

The circularity or average circularity of toner particles can be adjusted by the degree of aging of resin particles in the production of toner particles, heat treatment of toner particles, mixing of toner particles having different circularities, and the like.

The proportion of the fine carrier particles (Y) can be determined by the measurement of MDc. Further, the proportion can be adjusted according to a method similar to the above-described method for adjusting MDc.

The MDc/MDt is preferably 4.5 or more, and more preferably 5.0 or more, for example, from the viewpoint of suppressing the irregular conveyance of the two-component developer. Further, the MDc/MDt is preferably 6.5 or less, and more preferably 6.0 or less, from the viewpoint of suppressing the occurrence of toner-spent due to the crack or chip of toner particles.

Further, the sum of (2/5)X and Y is preferably 20 or less, and more preferably 16 or less, for example, from the viewpoint of reducing the contents of the fine carrier particles and the spherical fine toner particles being more likely to cause toner-spent, in the two-component developer.

Furthermore, X is preferably 14% or more, and more preferably 20% or more, from the viewpoint of productivity of toner particles. In addition, X is preferably 35% or less, and more preferably 30% or less, from the viewpoint of reducing the existing amount of the spherical fine toner particles in the two-component developer.

The toner particles include toner base particles. These toner base particles contain a binder resin and a colorant.

The binder resin composes the toner base particles, and incorporates the colorant in a dispersed manner. As the binder resin, it is possible to use a resin that can be used for the binder resin of a toner. Either one binder resin or two or more binder resins may be used. Examples thereof include a styrene-(meth)acrylic resin, a polyester resin, and a modified-polyester resin that is partially modified.

The styrene-(meth)acrylic resin has a molecular structure of a radical polymer of a compound having a radically polymerizable unsaturated bond, and can be synthesized, for example, by radical polymerization of this compound. Either one compound or two or more compounds may be employed, and examples thereof include styrene and its derivative, and (meth)acrylic acid and its derivative.

Examples of the styrene and its derivative include styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrene, p-n-nonylstyrene, p-n-decylstyrene, p-n-dodecylstyrene, 2,4-dimethylstyrene, and 3,4-dichlorostyrene.

Examples of the (meth)acrylic acid and its derivative include methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, β-hydroxyethyl acrylate, γ-aminopropyl acrylate, stearyl methacrylate, dimethylaminoethyl methacrylate, and diethylaminoethyl methacrylate.

The polyester has a molecular structure of a condensation polymerization product of a polyvalent carboxylic acid and a polyhydric alcohol, and can be synthesized, for example, by the condensation polymerization thereof Either one polyvalent carboxylic acid or two or more polyvalent carboxylic acids may be employed. Examples of the polyvalent carboxylic acid include aliphatic dicarboxylic acids, aromatic dicarboxylic acids, dicarboxylic acids having a double bond, trivalent or higher-valent carboxylic acids, anhydrides thereof, and lower alkyl esters thereof. A dicarboxylic acid having a double bond is preferred from the viewpoint of preventing hot offset of toner particles during fixing, because the dicarboxylic acid having a double bond is radically crosslinked via the double bond.

Examples of the aliphatic dicarboxylic acid include oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid.

Examples of the aromatic dicarboxylic acid include phthalic acid, isophthalic acid, terephthalic acid, naphthalene-2,6-dicarboxylic acid, malonic acid, and mesaconic acid.

Examples of the dicarboxylic acid having a double bond include maleic acid, fumaric acid, 3-hexenedioic acid, and 3-octenedioic acid. Among those, fumaric acid or maleic acid is preferred in terms of cost.

Examples of the trivalent or higher-valent carboxylic acid include 1,2,4-benzenetricarboxylic acid, 1,2,5-benzenetricarboxylic acid, and 1,2,4-naphthalenetricarboxylic acid.

Either one polyhydric alcohol or two or more polyhydric alcohols may be employed. Examples of the polyhydric alcohol include an aliphatic diol and a trihydric or higher-hydric alcohol. Among those, an aliphatic diol is preferred from the viewpoint of obtaining a crystalline polyester resin to be described later, and in particular a straight chain aliphatic diol having 7 to 20 carbon atoms in the main chain portion is more preferred.

When the aliphatic diol is the straight chain aliphatic diol, the crystallinity of polyester is maintained, and the melt temperature of the polyester is prevented from being lowered. Therefore, the straight chain aliphatic diol is preferred from the viewpoint of obtaining the two-component developer excellent in toner blocking resistance, image retention and low temperature fixability. Further, the straight chain aliphatic diol having 7 to 20 carbon atoms in the main chain portion is preferred from the viewpoints of restricting the melting point of a product obtained through polycondensation with an aromatic dicarboxylic acid to a low temperature, and of achieving low temperature fixation. In addition, a material therefor is easily available in terms of practical use. From these points of view, the straight chain aliphatic diol preferably has 7 to 14 carbon atoms in the main chain portion.

Examples of the aliphatic diol to be suitably used for the synthesis of the crystalline polyester resin include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanediol. Among those, 1,8-octanediol, 1,9-nonanediol or 1,10-decanediol is preferred, in terms of easy availability.

Examples of the trihydric or higher-hydric alcohol include glycerol, trimethylolethane, trimethylolpropane and pentaerythritol.

A chain transfer agent for adjusting the molecular weight of a resin to be obtained may be added to a monomer component used for synthesizing the binder resin. Either one chain transfer agent or two or more chain transfer agents may be employed; and the chain transfer agent may be used in an amount that enables the purpose to be obtained, as long as the effects of the present embodiment are achieved. Examples of the chain transfer agent include 2-chloroethanol, mercaptans such as octyl mercaptan, dodecyl mercaptan and t-dodecyl mercaptan, and a styrene dimer.

It is preferable that the binder resin includes a crystalline resin, from the viewpoints of allowing toner particles to be easily melted, and of achieving energy saving during the fixation onto a recording medium. The crystalline resin is a resin having crystallinity. Examples thereof include a crystalline polyester resin and a crystalline vinyl resin. Among those, a crystalline polyester resin is preferred, and an aliphatic crystalline polyester resin is more preferred.

The crystalline polyester resin may be produced by common polyester polymerization methods in which the acid component and alcohol component are reacted. Examples of the polymerization methods include direct polycondensation and an ester exchange method, and the polymerization methods are appropriately used depending on the type of monomers, for example.

The crystalline polyester resin can be produced at a polymerization temperature of 180 to 230° C., for example. The pressure inside the reaction system is reduced as necessary, and the monomers are reacted while removing water or an alcohol generated during condensation. When a monomer is not dissolved or compatible at the reaction temperature, a solvent having a high boiling point may be added as a solubilizing agent for solubilizing the monomer. The polycondensation reaction is conducted while distilling off the solubilizing solvent. When there is a monomer with low compatibility in the copolymerization reaction, it is better to allow the monomer with low compatibility and an acid or alcohol to be subjected to polycondensation with this monomer to undergo condensation in advance, before being subjected to the polycondensation together with the main component.

Either one colorant or two or more colorants may be employed. As the colorant, a known inorganic or organic colorant used for the colorant of a color toner is used. Examples of the colorant include carbon blacks, magnetic materials, pigments and dyes.

Examples of the carbon blacks include channel black, furnace black, acetylene black, thermal black and lamp black. Examples of the magnetic materials include ferromagnetic metals such as iron, nickel, and cobalt and alloys containing these metals; and compounds of ferromagnetic metals such as ferrite and magnetite.

Examples of the pigments include C.I. Pigment Red 2, 3, 5, 7, 15, 16, 48:1, 48:3, 53:1, 57:1, 81:4, 122, 123, 139, 144, 149, 166, 177, 178, 208, 209, and 222; C.I. Pigment Orange 31, and 43; C.I. Pigment Yellow 3, 9, 14, 17, 35, 36, 65, 74, 83, 93, 94, 98, 110, 111, 138, 139, 153, 155, 180, 181, and 185; C.I. Pigment Green 7; C.I. Pigment Blue 15:3, 15:4, and 60; and a phthalocyanine pigment having a central metal of zinc, titanium, magnesium, or the like.

Examples of the dyes include C.I. Solvent Red 1, 3, 14, 17, 18, 22, 23, 49, 51, 52, 58, 63, 87, 111, 122, 127, 128, 131, 145, 146, 149, 150, 151, 152, 153, 154, 155, 156, 157, 158, 176, and 179; pyrazolotriazole azo dye; pyrazolotriazole azomethine dye; pyrazolone azo dye; pyrazolone azomethine dye; C.I. Solvent Yellow 19, 44, 77, 79, 81, 82, 93, 98, 103, 104, 112, and 162; and C.I. Solvent Blue 25, 36, 60, 70, 93, and 95.

The base particles may further contain components other than the binder resin and colorant as long as the effects of the present embodiment are achieved. Examples of these other components include a release agent and a charge control agent. Either one other component or two or more other components may be contained.

Examples of the release agent (wax) include hydrocarbon waxes and ester waxes. Examples of the hydrocarbon waxes include low molecular weight polyethylene wax, low molecular weight polypropylene wax, Fischer Tropsch wax, microcrystalline wax, and paraffin wax. Further, examples of the ester waxes include carnauba wax, pentaerythritol behenic acid ester, behenyl behenate, and behenyl citrate.

Examples of the charge control agent include nigrosine dyes, metal salts of naphthenic acid or higher fatty acids, alkoxylated amines, quaternary ammonium salt compounds, azo metal complexes, and salicylic acid metal salts or metal complexes thereof From the viewpoint of properly controlling the particle diameter and circularity of the toner particles, the process for producing the toner base particles is preferably a build-up type toner production process such as emulsion association aggregation method, for example, a method in which colorant particles and binder resin particles dispersed in an aqueous medium are aggregated and fused to produce toner base particles, or suspension polymerization, rather than a pulverization method, and the emulsion association aggregation method is more preferred. The process for producing the toner base particles by means of the emulsion association aggregation method includes, for example, the following steps of:

(a) forming binder resin particles from a binder resin to prepare a binder resin particle dispersion liquid in which the binder resin particles are dispersed in an aqueous medium;

(b) aggregating the binder resin in the aqueous medium to obtain resin particles which become toner base particles (aggregation/fusing step);

(c) cooling; and (d) filtration, washing, and drying.

It is preferable that the toner particles further include an external additive, from the viewpoint of controlling the flow ability and chargeability of the toner particles. Either one external additive or two or more external additives may be employed. Examples of the external additive include silica particles, titania particles, alumina particles, zirconia particles, zinc oxide particles, chromium oxide particles, cerium oxide particles, antimony oxide particles, tungsten oxide particles, tin oxide particles, tellurium oxide particles, manganese oxide particles, and boron oxide particles.

The external additive more preferably includes silica particles produced by a sol-gel method. The silica particles produced by a sol-gel method are preferred from the viewpoint of suppressing the dispersion of adhesive strength of the external additive to the toner base particles, because the silica particles produced by a sol-gel method have a feature of narrow particle diameter distribution.

Further, the silica particles preferably have a number-average primary particle diameter of 70 to 200 nm. Silica particles having a number-average primary particle diameter within the above range are larger than other external additives, and therefore have a role of a spacer in the two-component developer. Accordingly, such silica particles are preferred from the viewpoint of preventing other smaller external additives from being embedded in the toner base particles when the two-component developer is stirred in a developing machine, and also from the viewpoint of preventing toner base particles from fusing together.

The number-average primary particle diameter of the external additive can be determined, for example, by image processing of an image photographed with a transmission electron microscope, and can be adjusted, for example, by classification, mixing of classified products, and the like.

The surface of the external additive is preferably subjected to hydrophobic treatment. For performing the hydrophobic treatment, a known surface-treating agent is used. Either one surface-treating agent or two or more surface-treating agents may be used, and examples thereof include a silane coupling agent, silicone oil, a titanate coupling agent, an aluminate coupling agent, a fatty acid, a fatty acid metal salt, an esterified product thereof, and a rosin acid.

Examples of the silane coupling agent include dimethylmethoxysilane, hexamethyldisilazane (HMDS), methyltrimethoxysilane, isobutyltrimethoxysilane and decyltrimethoxysilane. Examples of the silicone oil include a cyclic compound and a linear or branched organosiloxane; and more specific examples thereof include an organosiloxane oligomer, octamethylcyclotetrasiloxane, decamethylcyclopentasiloxane, tetramethylcyclotetrasiloxane, and tetravinyltetramethylcyclotetrasiloxane.

Further, examples of the silicone oil include a highly reactive silicone oil having at least a modified terminal, in which a modification group is introduced into a side chain, one terminal, both terminals, one terminal or both terminals of a side chain, or the like. The type of the modification group may be either one or two or more, and examples thereof include alkoxy, carboxyl, carbinol, a higher fatty acid-modified silicone oil, phenol, epoxy, methacryl and amino.

The addition amount of the external additive is preferably 0.1 to 10.0 mass %, and more preferably 1.0 to 3.0 mass % to the total amount of toner particles.

The carrier particles are composed of magnetic materials. Examples of the carrier particles include coated type carrier particles having a core material particle made of the magnetic material and a coating material layer that coats the surface of the core material particle, and resin-dispersed type carrier particles in which fine powders of the magnetic material are dispersed in the resin. It is preferable that the carrier particles are the coated type carrier particles, from the viewpoint of suppressing the adhesion of carrier particles to a photoconductor.

The core material particles are composed of a magnetic material, for example, a material that uses a magnetic field to magnetize an area in that direction. Either one magnetic material or two or more magnetic materials may be employed, and examples thereof include metals exhibiting ferromagnetic properties, such as iron, nickel and cobalt, alloys or compounds including these metals, and alloys exhibiting ferromagnetic properties upon heat treatment.

Examples of the metals exhibiting ferromagnetic properties or compounds including these metals include iron, a ferrite represented by Formula (a):

$$Mo.Fe_2O_3 \qquad \text{Formula (a),}$$

and a magnetite represented by Formula (b):

$$MFe_2O_4 \qquad \text{Formula (b)}$$

where M in Formulas (a) and (b) represents one or more monovalent or divalent metals selected from the group consisting of Mn, Fe, Ni, Co, Cu, Mg, Zn, Cd and Li.

Further, examples of the alloys exhibiting ferromagnetic properties upon heat treatment include Heusler's alloys such as manganese-copper-aluminum and manganese-copper-tin, and chromium dioxide.

The core material particles are preferably various ferrites, because the specific gravity of the coated type carrier particles is smaller than the specific gravity of a metal composing the core material particles to thereby enable the impact of stirring inside the developing machine to be smaller.

Either one coating material or two or more coating materials may be employed. As the coating material, a known resin to be utilized for the coating of core material particles of carrier particles can be used. It is preferable that the coating material is a resin having a cycloalkyl group, from the viewpoints of reducing the moisture adsorption properties of carrier particles and of enhancing the adhesion of the coating layer to the core material particle. Examples of the cycloalklyl group include cyclohexyl group, cyclopentyl group, cyclopropyl group, cyclobutyl group, cycloheptyl group, cyclooctyl group, cyclononyl group, and cyclodecyl group. Among those, cyclohexyl group or cyclopentyl group is preferred; and cyclohexyl group is more preferred from the viewpoint of the adhesion between the coating layer and the ferrite particle.

The weight-average molecular weight Mw of the resin having a cycloalkyl group is, for example, 10,000 to 800,000, and more preferably 100,000 to 750,000. The cycloalkyl group content in the resin is, for example, 10 mass % to 90 mass %. The cycloalkyl group content in the resin can be determined using a known analytical instrument such as pyrolysis-gas chromatography/mass spectrometry (P-GC/MS) or $^1$H-NMR, for example.

The two-component developer can be produced by mixing suitable amounts of the toner particles and the carrier particles. Examples of a mixer to be used for this mixing include Nauter mixer, a W-cone mixer and a V-shape mixer.

The two-component developer can be applied to a typical image forming method by the electrophotographic process.

For example, the two-component developer is housed in an image forming apparatus illustrated in FIG. 1, and is used for forming a toner image on a recording medium.

Image forming apparatus 1 illustrated in FIG. 1 includes image reading section 110, image processing section 30, image forming section 40, sheet conveying section 50, and fixing device 60.

Image forming section 40 has image forming units 41Y, 41M, 41C and 41K that form images with the respective color toners of Y (yellow), M (magenta), C (cyan) and K (black). All these units have the same configuration except toner to be housed therein, and therefore signs representing colors may be hereinafter abbreviated at times. Image forming section 40 further has intermediate transfer unit 42 and secondary transfer unit 43. These units correspond to a transfer device.

Image forming unit 41 has exposure device 411, developing device 412, photoconductor drum 413, charging device 414, and drum cleaning device 415. Photoconductor drum 413 is, for example, a negative charge type organic photoconductor. The surface of photoconductor drum 413 has photoconductive properties. Photoconductive drum 413 corresponds to a photoconductor. Charging device 414 is, for example, a corona charger. Charging device 414 may be a contact charging device that charges photoconductor drum 413 by contacting a contact charging member such as a charging roller, a charging brush or a charging blade with photoconductor 413. Exposure device 411 includes, for example, a semiconductor laser as a light source, and a light deflection device (polygon motor) that emits laser light in accordance with an image to be formed toward photoconductor drum 413.

Developing device 412 is a developing device in a two-component developing system. Developing device 412 includes, for example, a developing container that houses the two-component developer, a developing roller (magnetic roller) disposed rotatably at the opening of the developing container, a partition that parts the inside of the developing container such that the two-component developer can be in fluid communication, a conveyance roller for conveying the two-component developer on the opening side in the developing container toward the developing roller, and a stirring roller for stirring the two-component developer inside the developing container. The developing container contains the two-component developer according to the present embodiment.

Intermediate transfer unit 42 has intermediate transfer belt 421, a primary transfer roller 422 that presses intermediate transfer belt 421 into close contact with photoconductor drum 413, a plurality of support rollers 423 including backup roller 423A, and belt cleaning device 426. Intermediate transfer belt 421 is stretched in a loop manner by the plurality of support rollers 423. The rotation of at least one driving roller of the plurality of support rollers 423 allows intermediate transfer belt 421 to run at a constant speed in the direction of arrow A.

Secondary transfer unit 43 has endless secondary transfer belt 432, and a plurality of support rollers 431 including secondary transfer roller 431A. Secondary transfer belt 432 is stretched in a loop manner by secondary transfer roller 431A and support rollers 431.

Fixing device 60 has, for example, fixing roller 62, endless heat-generating belt 63 for covering the outer peripheral surface of fixing roller 62 and for heating and melting a toner composing a toner image on sheet S, and pressure roller 64 that presses sheet S against fixing roller 62 and heat-generating belt 63. Sheet S corresponds to a recording medium.

Image forming apparatus 1 further has image reading section 110, image processing section 30 and sheet conveying section 50. Image reading section 110 has sheet feeder 111 and scanner 112. Sheet conveying section 50 has sheet feeding section 51, sheet discharging section 52, and conveying path section 53. Sheet S (standard sheet, special sheet) identified based on basis weight or size is housed for each preset type in three sheet feeding tray units 51*a* to 51*c* which constitute sheet feeding section 51. Conveying path section 53 has a plurality of pairs of conveying rollers such a pair of resist rollers 53*a*.

The formation of an image by image forming apparatus 1 will be described. Scanner 112 optically scans and reads manuscript D on contact glass. Light reflected from manuscript D is read by CCD sensor 112*a* to be input as image data. The input image data is subjected to a predetermined image processing in image processing section 30, and sent to exposure device 411.

Photoconductor drum 413 rotates at a constant peripheral speed. Charging device 414 charges the surface of photoconductor drum 413 uniformly to a negative polarity. In exposure device 411, a polygon mirror of a polygon motor rotates at high speed, and laser light corresponding to the input image data of each color component travels along the axial direction of photoconductor drum 413 to be ejected onto the outer peripheral surface of photoconductor drum 413 along the axial direction. Thus, an electrostatic latent image is formed on the surface of photoconductor drum 413.

In developing device 412, the conveyance and stirring of the two-component developer inside the developing container allow toner particles to be charged, and the two-component developer is conveyed to the developing roller to form a magnetic brush on the surface of the developing roller. The charged toner particles electrostatically adhere to an electrostatic latent image portion on photoconductor drum 413 from the magnetic brush. Thus, the electrostatic latent image on the surface of photoconductor drum 413 is visualized, and a toner image in accordance with the electrostatic latent image is formed on the surface of photoconductive drum 413.

As described above, the two-component developer has toner particles whose number-average particle diameter ranges from 3.5 to 5.0 μm, and satisfies the Formulas 1 and 2. The toner particles of the two-component developer are relatively small, and the amounts of the fine carrier particles and spherical fine toner particles being likely to cause toner-spent are properly controlled. Therefore, in developing device 412, the two-component developer sufficiently flows, and the toner particles are charged evenly and sufficiently, so that the toner particles allows the electrostatic latent image to be developed faithfully even in fine detail.

The toner image on the surface of photoconductive drum 413 is transferred to intermediate transfer belt 421 by intermediate transfer unit 42. Untransferred toner remaining on the surface of photoconductive drum 413 after the transfer are removed by drum cleaning device 415 having a drum cleaning blade which slidably contacts the surface of photoconductive drum 413.

Primary transfer roller 422 presses intermediate transfer belt 421 into close contact with photoconductor drum 413, to thereby allows photoconductor drum 413 and intermediate transfer belt 421 to form a primary transfer nip for each photoconductor drum. At the primary transfer nip, toner images of the respective colors are transferred sequentially in a superimposed manner on intermediate transfer belt 421.

On the other hand, secondary transfer roller 431A is pressed into close contact with backup roller 423A with intermediate transfer belt 421 and secondary transfer belt 432 interposed therebetween. Thus, a secondary transfer nip is formed by intermediate transfer belt 421 and secondary transfer belt 432. Sheet S passes through the secondary transfer nip. Sheet S is conveyed to the secondary transfer nip by sheet conveying section 50. A resist roller section provided with pairs of resist rollers 53*a* corrects the inclination of sheet S and adjusts the timing of the conveyance.

When sheet S is conveyed to the secondary transfer nip, transfer bias is applied to secondary transfer roller 431A. The application of this transfer bias allows a toner image carried by intermediate transfer belt 421 to be transferred to sheet S. Sheet S on which the toner image is transferred is conveyed toward fixing device 60 by secondary transfer belt 432.

Fixing device 60 uses heat-generating belt 63 and pressure roller 64 to form a fixing nip and to heat and pressurize conveyed sheet S at the fixing nip portion. Thus, the toner image is fixed onto sheet S. The toner particles are relatively small, and thus more likely to be melted. Therefore, in the above-described toner image fixation, thermal energy (electric energy) required for fixation is further reduced compared to the case of fixing a toner image of conventional-sized toner particles. Sheet S on which the toner image is fixed is discharged out of the apparatus by sheet discharging section 52 provided with sheet discharging rollers 52*a*. Thus, a high-quality image without grainy feeling is formed.

It is noted that untransferred toner remaining on the surface of intermediate transfer belt 421 after the secondary transfer are removed by belt cleaning device 426 having a belt cleaning blade which slidably contacts the surface of intermediate transfer belt 421.

As is obvious from the above description, the two-component developer contains the toner particles and the carrier particles, with the number-average particle diameter of the toner particles MDt ranging from 3.5 to 5.0 μm, and satisfies the Formulas 1 and 2. Therefore, it is possible to maintain high flow ability of the two-component developer and suppress the occurrence of toner-spent even when smaller toner particles are used.

It is even more effective for the two-component developer to satisfy the following Formulas 3 and 4:

$$5.0 \leq MDc/MDt \leq 6.0 \quad \text{Formula 3}$$

$$(2/5)X+Y \leq 16 \text{ (with the proviso that } 14 \leq X \leq 35) \quad \text{Formula 4}$$

from the viewpoints of suppressing the irregular conveyance of the two-component developer, of suppressing the occurrence of toner-spent, of reducing the contents of the fine carrier particles and the spherical fine toner particles being likely to cause toner-spent, and of productivity of toner particles.

It is even more effective for the toner base particles of the toner particles to be toner base particles obtained by aggregating and fusing colorant particles and binder resin particles dispersed in an aqueous medium, from the viewpoint of properly controlling the particle diameter and circularity of the toner particles.

It is even more effective for the binder resin to include a crystalline resin, from the viewpoint of achieving energy saving during the fixation.

It is even more effective for the external additive of the toner particles to include silica particles produced by a sol-gel method and for the silica particles to have a number-average primary particle diameter of 70 to 200 nm, from the viewpoints of suppressing the dispersion of adhesive strength of the external additive to the toner base particles, and of preventing a smaller external additive from being embedded in the toner base particles.

It is even more effective for the carrier particles to have core material particles and a coating material layer that coats the surface of the core material particles and for the coating material to include a resin having a cycloalkyl group, from the viewpoints of suppressing the adhesion of carrier particles to a photoconductor, of reducing the moisture adsorption properties of carrier particles, and of enhancing the adhesion of the coating layer to the core material particle.

EXAMPLES

The present invention will be described further specifically with reference to the following examples and comparative examples. The present invention is not construed to be limited by the following Examples.

[Preparation of Colorant Microparticle Dispersion Liquid]

11.5 parts by mass of sodium n-dodecylsulfate was added to 160 parts by mass of ion-exchanged water, followed by stirring, and the dissolved solution was stirred, while 24.5 parts by mass of copper phthalocyanine was gradually added into the solution. Next, a dispersion treatment was performed using a stirring apparatus "CLEARMIX W-motion CLM-0.8" (manufactured by M Technique Co.) to prepare colorant microparticle dispersion liquid (Al) in which the volume-based median diameter of the copper phthalocyanine particles in the solution is 126 nm.

It is noted that the volume-based median diameter of the colorant microparticle dispersion liquid (Al) was determined using an electrophoretic light scattering photometer "ELS-800" (manufactured by Otsuka Electronics Co., Ltd.).

[Production of Crystalline Polyester Resin]

A three-necked flask was loaded with 300 g of 1,9-nonanediol, 250 g of dodecanedioic acid, and a catalyst $Ti(OBu)_4$ (0.014 mass % to a carboxylic acid monomer) to prepare a liquid mixture, and then the pressure of the air inside the container was reduced by a pressure-reducing operation. Further, a nitrogen gas was introduced into the three-necked flask to allow the inside of the flask to have an inert atmosphere, and the liquid mixture was refluxed at 180° C. for 6 hours under mechanical stirring. Thereafter, an unreacted monomer component was removed by distillation under reduced pressure, and the temperature was gradually elevated to 220° C., followed by stirring for 12 hours. When the mixture became viscous, the mixture was cooled to obtain a crystalline polyester resin (B1). The weight-average molecular weight (Mw) of the resultant crystalline polyester resin (B1) was 19,500. Further, the melting point of the crystalline polyester resin (B1) was 75° C.

Mw of the crystalline polyester resin (B1) is determined using an apparatus "HLC-8220" (manufactured by Tosoh Corporation) and a column "TSK guard column+TSK gel Super HZM-M 3 series" (manufactured by Tosoh Corporation)" according to the following procedures: tetrahydrofuran (THF) is flowed as a carrier solvent at a flow rate of 0.2 mL/min while maintaining a column temperature at 40° C.; 10 μL of a sample solution is injected into the apparatus; refractive index detector (RI detector) is used for detection; and a molecular weight distribution of the measurement sample was calculated using a calibration curve measured using monodisperse polystyrene standard particles.

The sample solution is prepared by dissolving the measurement sample in THF in a dissolving condition of performing 5-minute treatment using an ultrasonic disperser at room temperature so as to have a concentration of 1 mg/ml, followed by filtration with a membrane filter having a pore size of 0.2 μm. Further, the calibration curve is prepared by measuring at least about 10 standard polystyrene samples. As the standard polystyrene sample, standard polystyrene samples (manufactured by Pressure Chemical Company) having molecular weights of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.48\times10^6$ are used.

The melting point of the crystalline polyester resin (B1) is determined according to the following procedures: measurement is performed using a differential scanning calorimeter "Diamond DSC" (manufactured by PerkinElmer Co., Ltd.), and 3.0 mg of the sample is sealed in an aluminum-made pan and then placed in a sample holder, with an empty aluminum-made pan being set as a reference, according to measuring conditions (temperature elevating/cooling conditions) which undergoes, sequentially, a first heating process in which the temperature of the crystalline polyester resin (B1) is elevated from 0 to 200° C. at an elevating rate of 10° C./min, a cooling process in which the temperature of the crystalline polyester resin (B1) is cooled from 200 to 0° C. at a cooling rate of 10° C./min, and a second heating process in which the temperature of the crystalline polyester resin (B1) is elevated from 0 to 200° C. at an elevating rate of 10° C./min; and the melting point of the crystalline polyester resin (B1) is determined as an endothermic peak top temperature derived from the crystalline polyester in the first heating process in the DSC curve obtained by this measurement.

[Preparation of Dispersion Liquid of Resin Particles (C1) (First Step Polymerization)]

4 g of polyoxyethylene (2) sodium dodecyl ether sulfate and 3,000 g of ion-exchanged water were charged into a 5 L reaction vessel equipped with a stirrer, a temperature sensor, a condenser, and a nitrogen inlet device, and the temperature of the resultant liquid mixture was elevated to 80° C. while stirring the liquid mixture at a stirring speed of 230 rpm under a nitrogen stream. After the temperature elevation, a solution of 10 g of potassium persulfate dissolved in 200 g of ion-exchanged water was added to the liquid mixture, and the liquid temperature of the liquid mixture was lowered to 75° C. A monomer liquid mixture having the composition of:

| | |
|---|---|
| styrene | 568 g; |
| n-butyl acrylate | 164 g; and |
| methacrylic acid | 68 g |

was added dropwise to the liquid mixture over 1 hour. Subsequently, the monomer was polymerized by heating the liquid mixture at 75° C. for 2 hours under stirring to prepare a dispersion liquid of resin particles (C1).

[Preparation of Dispersion Liquid of Resin Particles (C2) (Second Step Polymerization)]

A solution of 2 g of polyoxyethylene (2) sodium dodecyl ether sulfate dissolved in 3,000 g of ion-exchanged water was charged into a 5 L reaction vessel equipped with a stirrer, a temperature sensor, a condenser, and a nitrogen inlet device, and the resultant liquid mixture was heated to 80° C.

On the other hand, a solution of a monomer having the composition of:

| | |
|---|---|
| resin particles (C1) | 42 g (in terms of solid content); |
| wax | 70 g; |
| crystalline polyester resin (B1) | 70 g; |
| styrene | 195 g; |
| n-butyl acrylate | 91 g; |
| methacrylic acid | 20 g; and |
| n-octylmercaptan | 3 g |

dissolved at 80° C. was prepared. Thereafter, the solution was added to the liquid mixture, and mixing and dispersion were performed for 1 hour using a mechanical disperser "CLEARMIX" (manufactured by M technique Co., Ltd.) having a circulating path to prepare a dispersion liquid containing emulsified particles (oil droplets). Next, an initiator solution in which 5 g of potassium persulfate was dissolved in 100 g of ion-exchanged water was prepared, and added to the dispersion liquid. The resultant dispersion liquid was heated at 80° C. over 1 hour while under for polymerization of the monomer to prepare a dispersion liquid of resin particles (C2).

It is noted that the wax is "HNP-0190" (manufactured by Nippon Seiro Co., Ltd.).

[Preparation of Dispersion Liquid of Fine Resin Particles for Core (C3) (Third Step Polymerization)]

A solution of 10 g of potassium persulfate dissolved in 200 g of ion-exchanged water was further added to the dispersion liquid of the resin particles (C2), and the resultant dispersion liquid was maintained at 80° C. A monomer liquid mixture having the composition of:

| | |
|---|---|
| styrene | 298 g; |
| n-butyl acrylate | 137 g; |
| n-stearyl acrylate | 50 g; |
| methacrylic acid | 64 g; and |
| n-octylmercaptan | 6 g |

was added dropwise to the dispersion liquid over 1 hour. After completion of the dropwise addition, the resultant dispersion liquid was heated over 2 hours under stirring for polymerization of the monomer, and then the dispersion liquid was cooled to 28° C. to prepare a dispersion liquid of fine resin particles for core (C3).

[Preparation of Dispersion Liquid of Fine Particles for Shell (D1)]

A reaction vessel equipped with a stirrer, a temperature sensor, a condenser, and a nitrogen inlet device was charged with a surfactant solution in which 2.0 g of polyoxyethylene sodium dodecyl ether sulfate was dissolved in 3,000 g of ion-exchanged water, and the temperature of the solution was elevated to 80° C. under stirring at a stirring speed of 230 rpm under a nitrogen stream. To this solution was added an initiator solution in which 10 g of potassium persulfate was dissolved in 200 g of ion-exchanged water, and a monomer liquid mixture having the composition of:

| | |
|---|---|
| styrene | 564 g; |
| n-butyl acrylate | 140 g; |
| methacrylic acid | 96 g; and |
| n-octylmercaptan | 12 g |

was added dropwise to the solution over 3 hours. After the dropwise addition, the resultant liquid mixture was heated at 80° C. over 1 hour under stirring for polymerization of the monomer to prepare a dispersion liquid of fine resin particles for shell (D1).

[Production of Core Shell Particles (Aggregation and Fusing Step)]

A 5 L reaction vessel equipped with a stirrer, a temperature sensor, a condenser, and a nitrogen inlet device was charged with 360 g (in terms of solid content) of the dispersion liquid of fine resin particles for core (C3), 1,100 g of ion-exchanged water and 50 g of the colorant microparticle dispersion liquid (Al). The temperature of the resultant dispersion liquid was adjusted to 30° C., and subsequently a 5N aqueous sodium hydroxide solution was added to the dispersion liquid to adjust the pH of the dispersion liquid to 10. Next, an aqueous solution in which 60 g of magnesium chloride was dissolved in 60 g of ion-exchanged water was added to the dispersion liquid at 30° C. over 10 minutes under stirring. After the addition, the dispersion liquid was held at 30° C. for 3 minutes, and then the temperature was started to be elevated. The temperature of the dispersion liquid was elevated to 85° C. over 60 minutes, and the particle growth reaction was continued while holding the temperature of the dispersion liquid at 85° C. to prepare a dispersion liquid of precore particles (1).

In this state, the particle diameter of associated precore particles (1) was measured using "Coulter Multisizer 3" (manufactured by Beckman Coulter, Inc.), and at the time when the number-based median diameter of the precore particles (1) was 4.1 μm, an aqueous solution in which 40 g of sodium chloride was dissolved in 160 g of ion-exchanged water was added to the dispersion liquid to stop the growth of the precore particles (1). Further, the dispersion liquid was stirred at a liquid temperature of 80° C. over 1 hour as an aging step, thereby advancing fusion between the precore particles (1), to form core particles (1).

Next, 80 g (in terms of solid content) of the fine resin particles for shell (D1) was added, and the stirring was continued for 1 hour at 80° C. The fine resin particles for shell (D1) were fused on the surface of the core particles (1) for formation of a shell layer, to obtain resin particles (1). Here, an aqueous solution in which 150 g of sodium chloride was dissolved in 600 g of ion-exchanged water was added to the resultant dispersion liquid, and an aging treatment was performed at a liquid temperature of 80° C. At the time when the average circularity of the resin particles (1) was 0.950, the dispersion liquid was cooled to 30° C. The cooled core shell particles (1) had a number-based median diameter of 4.2 μm and an average circularity of 0.950.

It is noted that the average circularity of the core shell particles (1) was determined as an average value of circularities obtained using a flow type particle image analyzer "FPIA-3000" according to the above-described measuring conditions. Further, the number-average median diameter of the core shell particles (1) is measured using "Coulter Multisizer 3" similarly to the measurement of the core particles (1).

[Production of Toner Base Particles (Washing and Drying Step)]

The dispersion liquid of the core shell particles (1) generated in the aggregation and fusing steps was subjected to solid-liquid separation using a centrifugal separator to form a wet cake of core shell particles. The wet cake was washed with ion-exchanged water at 35° C. until the electric conductivity of the filtrate reached 5 μS/cm using the centrifugal separator, then moved to "Flash Jet Dryer" (manufactured by Seishin Enterprise Co., Ltd.), and dried until the moisture amount was 0.8 mass % to produce toner base particles 1. The proportion X of spherical toner base fine particles in the toner base particles 1 was 8.2%.

X (%) of the toner base particles 1 was determined using "FPIA-3000". It is noted that the spherical toner base fine particles are particles having a number distribution-based particle diameter of 3.0 to 4.5 μm and a circularity of 0.980 or more.

[Production of Toner Base Particles 2 to 19]

Toner base particles 2 to 8 were produced similarly to the toner base particles 1, except that the temperatures of the dispersion liquids of the resin particles were lowered to 30° C. at the time when the average circularities of the resin particles were 0.953, 0.955, 0.960, 0.965, 0.970, 0.985 and 0.987, respectively. The Xs of the toner base particles 2 and 3 were both 10.1%, and the Xs of the toner base particles 4, 5, 6, 7, and 8 were, respectively, 14.0%, 17.4%, 19.6%, 29.3%, and 32.1%.

Toner base particles 9 were produced similarly to the toner base particles 1, except that the growth of the precore particles was stopped at the time when the number-based median diameter of the precore particles was 3.4 μm and that the temperature of the dispersion liquid of the resin particles was lowered to 30° C. at the time when the average circularity of the resin particles was 0.942. The number-based median diameter of the core shell particles of the toner base particles 9 (core shell particles (9)) was 3.5 μm, and the value of X for the toner base particles 9 was 8.2%.

Toner base particles 10 to 16 were produced similarly to the toner base particles 9, except that the temperatures of the dispersion liquids of the resin particles were lowered to 30° C. at the time when the average circularities of the resin particles were 0.948, 0.960, 0.965, 0.975, 0.980, 0.985 and 0.987, respectively. The values of X for the toner base particles 10, 11, 12, 13, 14, 15, and 16 were, respectively, 10.2%, 20.1%, 24.8%, 32.4%, 36.2%, 39.9%, and 41.1%.

Toner base particles 17 were produced similarly to the toner base particles 1, except that the growth of the precore particles was stopped at the time when the number-based median diameter of the precore particles was 4.9 μm and that the temperature of the dispersion liquid of the resin particles was lowered to 30° C. at the time when the average circularity of the resin particles was 0.965. The number-based median diameter of the core shell particles of the toner base particles 17 (core shell particles (17)) was 5.0 μm, and the value of X for the toner base particles 17 was 10.2%.

Toner base particles 18 were produced similarly to the toner base particles 1, except that the growth of the precore particles was stopped at the time when the number-based median diameter of the precore particles was 3.3 μm and that the temperature of the dispersion liquid of the resin particles was lowered to 30° C. at the time when the average circularity of the resin particles was 0.970. The number-based median diameter of the core shell particles of the toner base particles 18 (core shell particles (18)) was 3.4 μm, and the value of X for the toner base particles 18 was 29.5%.

Toner base particles 19 were produced similarly to the toner base particles 1, except that the growth of the precore particles was stopped at the time when the number-based median diameter of the precore particles was 5.0 μm and that the temperature of the dispersion liquid of the resin particles was lowered to 30° C. at the time when the average circularity of the resin particles was 0.970. The number-based median diameter of the core shell particles of the toner base particles 19 (core shell particles (19)) was 5.1 μm, and the value of X for the toner base particles 19 was 10.2%.

[Production of Toner Particles 1 (External Additive Treatment Step)]

The following powders in the following amounts:

| | |
|---|---|
| sol-gel silica | 2.0 mass %; |
| hydrophobic silica | 2.5 mass %; and |
| hydrophobic titanium oxide | 0.5 mass % |

were added to the toner base particles 1, and the mixture was added to a Henschel mixer, model "FM20C/I" (manufactured by Nippon coke & Engineering Co., Ltd.), followed by stirring for 15 minutes at a blade edge peripheral speed of 40 m/s which had been set by adjusting the revolution speed of stirring blades, to produce toner particles 1.

The "sol-gel silica" is treated with hexamethyldisilazane (HMDS), and has a hydrophobicity of 72% and a number-average primary particle diameter of 130 nm. In addition, the "hydrophobic silica" is treated with HMDS, and has a hydrophobicity of 72% and a number-average primary particle diameter of 40 nm. Further, the "hydrophobic titanium oxide" is treated with HMDS, and has a hydrophobicity of 55% and a number-average primary particle diameter of 20 nm. Furthermore, the addition amounts of the powders are addition amounts of the respective powders in the toner particles 1.

The temperature of the mixed powders at the time when the powders are externally added to and mixed with the toner particles 1 was set at 40° C.±1° C. The temperature inside the Henschel mixer was controlled by flowing cooled water at a flow rate of 5 L/min to the outer bath of the Henschel mixer when the temperature was 41° C., and by flowing cooled water so that the flow rate of the cooled water was 1 L/min when the temperature was 39° C.

It is noted that a catalogue value may be employed for the number-average primary particle diameter of the powders, but alternatively it can also be determined by the processing of an image photographed by a transmission electron microscope. For example, the toner particles 1 were photographed at a magnification of 10,000 and at an accelerating voltage of 80 kV using "JEM-2000FX" (manufactured by JEOL Ltd.), and the photographic image was captured by a scanner and subjected to binarization processing in terms of external additive particles using an image processing analyzer "LUZEX AP" (manufactured by Nireco Corporation, "LUZEX" is a registered trademark of this company) to calculate Feret's diameters of 100 particles in the horizontal direction, so that the number-average primary particle diameter of the powders can be determined as an average value thereof "Feret's diameters in the horizontal direction" is the length of a side parallel to a circumscribed rectangle in the longitudinal direction, when the image of the external additive particles is subjected to binarization processing.

[Production of Toner Particles 2 to 19]

Toner particles 2 to 19 were obtained similarly to the toner particles 1, except that the toner base particles 2 to 19 were used respectively in place of the toner base particles 1.

It is noted that the average circularities of the toner particles 1 to 19 were the same respectively as the average circularities of the core shell particles in the toner particles (core shell particles (1) to (19)). Further, the number distribution-based median diameters D50t of the toner particles 1 to 19 were the same respectively as the median diameters of the core shell particles in the toner particles (core shell particles (1) to (19)).

[Production of Resin for Coating Core Material (Coating Material 1)]

To an aqueous solution of 0.3 mass % of sodium benzenesulfonate were added cyclohexyl methacrylate and methyl methacrylate at a molar ratio of 1:1, followed by addition of potassium persulfate in an amount equivalent to 0.5 mass % of the total amount of monomers to perform emulsion polymerization, and resin particles in the resultant dispersion liquid were dried by spray-drying of the dispersion liquid to produce coating material 1 which is a resin for coating core material. The resultant coating material 1 had a weight-average molecular weight Mw of 500,000. Mw of coating material 1 was determined by Gel Permeation Chromatography (GPC) similarly to the above-described crystalline polyester resin (B1).

[Production of Carrier Particles 1]

Mn—Mg ferrite particles having a volume-average diameter of 15 μm were prepared as core material particles. 100 parts by mass of the ferrite particles and 4.5 parts by mass of coating material 1 were loaded into a high-speed stirring mixer with horizontal stirring blades, and mixed and stirred at 22° C. for 15 minutes under the condition that the peripheral speed of the horizontal revolving blade was 8 m/sec. Thereafter, mixing was performed at 120° C. for 50 minutes, and the surface of the core material particles was coated with coating material 1 by the action of mechanical impact (mechanochemical method) to prepare carrier particles 1. The volume distribution-based median diameter of the carrier particles 1 (D50c) was 15.5 μm, and the proportion of the fine carrier particles in the carrier particles 1 (Y) was 2.4%.

The D50c and Y of the carrier particles 1 were determined based on the above-described method using a laser diffraction particle size distribution measuring apparatus "HELOS KA" (manufactured by Japan Laser Corporation). It is noted that the "fine carrier particles" are particles having a particle diameter of two thirds or less of the D50c.

[Production of Carrier Particles 2 to 16]

Carrier particles 2 to 16 were produced similarly to the carrier particles 1, except that the loading amount of the coating material 1 was changed. In the carrier particles 2, D50c was 16.0 μm, and Y was 2.4%.

Further, in the carrier particles 3, D50c was 18.0 μm, and Y was 2.9%. In the carrier particles 4, D50c was 18.5 μm, and Y was 3.0%. In the carrier particles 5, D50c was 19.0 μm, and Y was 3.3%. In the carrier particles 6, D50c was 20.0 μm, and Y was 4.0%. In the carrier particles 7, D50c was 22.0 μm, and Y was 6.8%. In the carrier particles 8, D50c was 22.5 μm, and Y was 7.2%. In the carrier particles 9, D50c was 23.0 μm, and Y was 8.1%. In the carrier particles 10, D50c was 25.0 μm, and Y was 10.0%.

Furthermore, in the carrier particles 11, D50c was 27.0 μm, and Y was 12.7%. In the carrier particles 12, D50c was 27.5 μm, and Y was 13.1%. In the carrier particles 13, D50c was 28.0 μm, and Y was 14.0%. In the carrier particles 14, D50c was 30.0 μm, and Y was 14.8%. In the carrier particles 15, D50c was 32.5 μm, and Y was 15.8%. In the carrier particles 16, D50c was 33.0 μm, and Y was 16.0%.

[Production of Two-Component Developer 1]

The toner particles 2 and the carrier particles 11 were mixed such that the toner particle content (toner concentration) in a two-component developer was 7 mass % to produce two-component developer 1. V-type mixer was used for the mixing. Mixing time was set at 30 minutes. Further, two-component developers 2 to 22 and C1 to C20 were produced similarly to the two-component developer 1, except that the combination of the toner particles and the carrier particles was changed to combinations listed in Tables 1 and 2 shown below. The combinations of toner particles and carrier particles in the two-component developers 1 to 22 and the physical property values thereof are shown in Tables 1 and 2, and the combinations of toner particles and carrier particles in the two-component developers C1 to C20 and the physical property values thereof are shown in Tables 3 and 4.

TABLE 1

| Ex. No. | Two-Component Developer No. | Toner Particles No. | Toner Particles D50t (μm) | Toner Particles Average Circularity (—) | Toner Particles X (%) | Carrier Particles No. | Carrier Particles D50c (μm) | Carrier Particles Y (%) | D50c/D50t (—) | (2/5)X + Y (—) |
|---|---|---|---|---|---|---|---|---|---|---|
| 1 | 1 | 2 | 4.2 | 0.953 | 10.2 | 11 | 27.0 | 12.7 | 6.43 | 16.8 |
| 2 | 2 | 3 | 4.2 | 0.955 | 10.3 | 9 | 23.0 | 8.1 | 5.48 | 12.2 |
| 3 | 3 | 4 | 4.2 | 0.960 | 14.0 | 5 | 19.0 | 3.3 | 4.52 | 8.9 |
| 4 | 4 | 4 | 4.2 | 0.960 | 14.0 | 9 | 23.0 | 8.1 | 5.48 | 13.7 |
| 5 | 5 | 4 | 4.2 | 0.960 | 14.0 | 11 | 27.0 | 12.7 | 6.43 | 18.3 |
| 6 | 6 | 5 | 4.2 | 0.965 | 17.4 | 11 | 27.0 | 12.7 | 6.43 | 19.7 |
| 7 | 7 | 6 | 4.2 | 0.970 | 19.6 | 9 | 23.0 | 8.1 | 5.48 | 15.9 |
| 8 | 8 | 7 | 4.2 | 0.985 | 29.3 | 9 | 23.0 | 8.1 | 5.48 | 19.8 |
| 9 | 9 | 10 | 3.5 | 0.948 | 10.2 | 6 | 20.0 | 4.0 | 5.71 | 8.1 |
| 10 | 10 | 10 | 3.5 | 0.948 | 10.2 | 2 | 16.0 | 2.4 | 4.57 | 6.5 |

TABLE 2

| Ex. No. | Two-Component Developer No. | Toner Particles No. | Toner Particles D50t (μm) | Toner Particles Average Circularity (—) | Toner Particles X (%) | Carrier Particles No. | Carrier Particles D50c (μm) | Carrier Particles Y (%) | D50c/D50t (—) | (2/5)X + Y (—) |
|---|---|---|---|---|---|---|---|---|---|---|
| 11 | 11 | 11 | 3.5 | 0.960 | 19.9 | 2 | 16.0 | 2.4 | 4.57 | 10.4 |
| 12 | 12 | 11 | 3.5 | 0.960 | 19.9 | 5 | 19.0 | 3.3 | 5.43 | 11.3 |
| 13 | 13 | 11 | 3.5 | 0.960 | 19.9 | 8 | 22.5 | 7.2 | 6.43 | 15.2 |
| 14 | 14 | 12 | 3.5 | 0.965 | 24.8 | 6 | 20.0 | 4.0 | 5.71 | 13.9 |
| 15 | 15 | 13 | 3.5 | 0.975 | 32.4 | 2 | 16.0 | 2.4 | 4.57 | 15.4 |
| 16 | 16 | 13 | 3.5 | 0.975 | 32.4 | 6 | 20.0 | 4.0 | 5.71 | 17.0 |
| 17 | 17 | 14 | 3.5 | 0.980 | 36.2 | 2 | 16.0 | 2.4 | 4.57 | 16.9 |
| 18 | 18 | 15 | 3.5 | 0.985 | 39.9 | 2 | 16.0 | 2.4 | 4.57 | 18.4 |
| 19 | 19 | 15 | 3.5 | 0.985 | 39.9 | 6 | 20.0 | 4.0 | 5.71 | 20.0 |
| 20 | 20 | 17 | 5.0 | 0.965 | 10.2 | 8 | 22.5 | 7.2 | 4.50 | 11.3 |
| 21 | 21 | 17 | 5.0 | 0.965 | 10.2 | 12 | 27.5 | 13.1 | 5.50 | 17.2 |
| 22 | 22 | 17 | 5.0 | 0.965 | 10.2 | 15 | 32.5 | 15.4 | 6.50 | 19.5 |

TABLE 3

| Comp. Ex. No. | Two-Component Developer No. | Toner Particles No. | Toner Particles D50t (μm) | Toner Particles Average Circularity (—) | Toner Particles X (%) | Carrier Particles No. | Carrier Particles D50c (μm) | Carrier Particles Y (%) | D50c/D50t (—) | (2/5)X + Y (—) |
|---|---|---|---|---|---|---|---|---|---|---|
| 1 | C1 | 1 | 4.2 | 0.950 | 8.2 | 9 | 23.0 | 8.1 | 5.48 | 11.4 |
| 2 | C2 | 1 | 4.2 | 0.950 | 8.2 | 11 | 27.0 | 12.7 | 6.43 | 16.0 |
| 3 | C3 | 4 | 4.2 | 0.960 | 14.0 | 4 | 18.5 | 3.0 | 4.40 | 8.6 |
| 4 | C4 | 4 | 4.2 | 0.960 | 14.0 | 12 | 27.5 | 13.1 | 6.55 | 18.7 |
| 5 | C5 | 6 | 4.2 | 0.970 | 19.6 | 11 | 27.0 | 12.7 | 6.43 | 20.5 |
| 6 | C6 | 8 | 4.2 | 0.987 | 32.1 | 9 | 23.0 | 8.1 | 5.48 | 20.9 |
| 7 | C7 | 9 | 3.5 | 0.942 | 8.2 | 6 | 20.0 | 4.0 | 5.71 | 7.3 |
| 8 | C8 | 9 | 3.5 | 0.942 | 8.2 | 2 | 16.0 | 2.4 | 4.57 | 5.7 |
| 9 | C9 | 4 | 3.5 | 0.960 | 19.9 | 1 | 15.5 | 2.4 | 4.43 | 10.4 |
| 10 | C10 | 4 | 3.5 | 0.960 | 19.9 | 9 | 23.0 | 8.1 | 6.57 | 16.1 |

TABLE 4

| Comp. Ex. No. | Two-Component Developer No. | Toner Particles No. | Toner Particles D50t (μm) | Toner Particles Average Circularity (—) | Toner Particles X (%) | Carrier Particles No. | Carrier Particles D50c (μm) | Carrier Particles Y (%) | D50c/D50t (—) | (2/5)X + Y (—) |
|---|---|---|---|---|---|---|---|---|---|---|
| 11 | C11 | 8 | 3.5 | 0.987 | 41.1 | 6 | 20.0 | 4.0 | 5.71 | 20.4 |
| 12 | C12 | 8 | 3.5 | 0.987 | 41.1 | 2 | 16.0 | 2.4 | 4.57 | 18.8 |
| 13 | C13 | 17 | 5.0 | 0.965 | 10.2 | 7 | 22.0 | 6.8 | 4.40 | 10.9 |
| 14 | C14 | 17 | 5.0 | 0.965 | 10.2 | 16 | 33.0 | 15.5 | 6.60 | 19.6 |
| 15 | C15 | 18 | 3.4 | 0.960 | 20.3 | 1 | 15.5 | 2.4 | 4.56 | 10.5 |
| 16 | C16 | 18 | 3.4 | 0.960 | 20.3 | 3 | 18.0 | 2.9 | 5.29 | 11.0 |
| 17 | C17 | 18 | 3.4 | 0.960 | 20.3 | 7 | 22.0 | 6.8 | 6.47 | 14.9 |
| 18 | C18 | 19 | 5.1 | 0.970 | 10.4 | 9 | 23.0 | 8.1 | 4.51 | 12.3 |
| 19 | C19 | 19 | 5.1 | 0.970 | 10.4 | 13 | 28.0 | 14.0 | 5.49 | 18.2 |
| 20 | C20 | 19 | 5.1 | 0.970 | 10.4 | 16 | 33.0 | 15.4 | 6.47 | 19.6 |

[Evaluation]

As an evaluation apparatus, a commercially available digital full-color multifunctional machine "bizhub PRO C6500" (manufactured by Konica Minolta, Inc., "bizhub" is a registered trademark of this company) was used. The two-component developers 1 to 22 and C1 to C20 were loaded into the apparatus, and printing (durable printing) was performed on 100,000 sheets of A4 size wood-free paper (65 g/m$^2$) on which a belt-shaped solid image is formed as a test image at a coverage rate of 5% under the environment of high temperature and high humidity (30° C., 80% RH).

(1) Image Quality (Graininess, GI Value)

At the initial printing stage and after the durable printing on 100,000 sheets, images with gradation patterns at 32 gradient scales were output using the respective two-component developers 1 to 22 and C1 to C20. As for the evaluation of the graininess in the images, the gradation patterns were read by CCD, and the obtained read value was subjected to Fourier transform processing taking account of MTF (Modulation Transfer Function) correction, followed by measurement of GI value (Graininess Index) adapted to human spectral luminous efficiency to determine the maximum GI value. Smaller GI value is better, and smaller GI value indicates less grainy feeling. It is noted that the GI value is a value set forth in Journal of the Imaging Society of Japan, 39 (2), pp. 84-93 (2000). According to the following evaluation criteria, the graininess of the gradation patterns in the images at the initial printing stage and after the durable printing was evaluated.

The images with gradation patterns output at the initial printing stage were judged, based on the maximum GI value (GIi) in these images, according to the following criteria:

A: GIi is less than 0.170

B: GIi is 0.170 or more and less than 0.180

C: GIi is 0.180 or more

Further, the images with gradation patterns output after the durable printing were judged, based on the difference between the GIi and the maximum GI value in the gradation patterns after the durable printing GIa (ΔGI (GIa-GIi)), according to the following criteria:

A: ΔGI is 0 or more and less than 0.010

B: ΔGI is 0.010 or more and less than 0.020

C: ΔGI is 0.020 or more (2) Toner-spent

After the durable printing, the two-component developer used was taken out from the evaluation apparatus, and the two-component developer was washed with an aqueous surfactant solution to collect carrier particles from the two-component developer. 3 g of the carrier particles were dissolved in 100 mL of methyl ethyl ketone, and the transmittance of light at a wavelength of 630 nm in the resultant solution was determined to judge the toner-spent according to the following criteria:

A: Transmittance is 95% or more

B: Transmittance is less than 95% and 90% or more

C: Transmittance is less than 90%

Evaluation results of the two-component developers 1 to 22 are shown in Tables 5 and 6, and evaluation results of the two-component developers C1 to C20 are shown in Tables 7 and 8.

TABLE 5

| Ex. No. | Two-Component Developer No. | Graininess: Initial Stage GIi (—) | Initial Stage Judgment | After Durable Printing GIa (—) | After Durable Printing ΔGI (—) | After Durable Printing Judgment | Toner-spent Transmittance (%) | Toner-spent Judgment |
|---|---|---|---|---|---|---|---|---|
| 1 | 1 | 0.174 | B | 0.192 | 0.018 | B | 94.3 | B |
| 2 | 2 | 0.168 | B | 0.186 | 0.018 | B | 92.2 | B |
| 3 | 3 | 0.159 | A | 0.168 | 0.009 | A | 93.3 | B |
| 4 | 4 | 0.158 | A | 0.167 | 0.009 | A | 96.2 | A |
| 5 | 5 | 0.168 | B | 0.183 | 0.015 | B | 92.2 | B |
| 6 | 6 | 0.172 | B | 0.184 | 0.012 | B | 92.2 | B |
| 7 | 7 | 0.155 | A | 0.165 | 0.010 | A | 95.8 | A |
| 8 | 8 | 0.159 | A | 0.170 | 0.011 | B | 92.2 | A |
| 9 | 9 | 0.178 | B | 0.193 | 0.015 | B | 90.1 | B |
| 10 | 10 | 0.176 | B | 0.188 | 0.012 | B | 92.3 | B |

TABLE 6

| Ex. No. | Two-Component Developer No. | Graininess: Initial Stage GIi (—) | Initial Stage Judgment | After Durable Printing GIa (—) | After Durable Printing ΔGI (—) | After Durable Printing Judgment | Toner-spent Transmittance (%) | Toner-spent Judgment |
|---|---|---|---|---|---|---|---|---|
| 11 | 11 | 0.165 | A | 0.182 | 0.017 | B | 90.4 | B |
| 12 | 12 | 0.158 | A | 0.167 | 0.009 | A | 95.3 | A |
| 13 | 13 | 0.161 | A | 0.179 | 0.018 | B | 94.2 | B |
| 14 | 14 | 0.159 | A | 0.168 | 0.009 | A | 95.3 | A |
| 15 | 15 | 0.158 | A | 0.175 | 0.017 | B | 94.3 | B |
| 16 | 16 | 0.165 | A | 0.179 | 0.014 | B | 92.2 | B |
| 17 | 17 | 0.166 | A | 0.179 | 0.013 | B | 91.8 | B |
| 18 | 18 | 0.164 | A | 0.177 | 0.013 | B | 92.1 | B |
| 19 | 19 | 0.169 | A | 0.179 | 0.010 | B | 93.2 | B |
| 20 | 20 | 0.174 | B | 0.186 | 0.012 | B | 90.2 | B |
| 21 | 21 | 0.173 | B | 0.182 | 0.009 | A | 93.8 | B |
| 22 | 22 | 0.173 | B | 0.185 | 0.012 | B | 96.4 | A |

TABLE 7

| Comp. Ex. No. | Two-Component Developer No. | Graininess: Initial Stage GIi (—) | Initial Stage Judgment | After Durable Printing GIa (—) | After Durable Printing ΔGI (—) | After Durable Printing Judgment | Toner-spent Transmittance (%) | Toner-spent Judgment |
|---|---|---|---|---|---|---|---|---|
| 1 | C1 | 0.181 | C | 0.198 | 0.017 | B | 90.3 | B |
| 2 | C2 | 0.191 | C | 0.211 | 0.020 | C | 91.5 | B |
| 3 | C3 | 0.162 | B | 0.176 | 0.014 | B | 88.8 | C |
| 4 | C4 | 0.174 | B | 0.188 | 0.014 | B | 89.8 | C |
| 5 | C5 | 0.165 | B | 0.179 | 0.014 | B | 89.1 | C |
| 6 | C6 | 0.162 | B | 0.175 | 0.013 | B | 88.3 | C |
| 7 | C7 | 0.177 | B | 0.195 | 0.018 | B | 87.8 | C |
| 8 | C8 | 0.176 | B | 0.199 | 0.023 | C | 86.8 | C |
| 9 | C9 | 0.171 | B | 0.193 | 0.022 | C | 86.6 | C |
| 10 | C10 | 0.172 | B | 0.194 | 0.022 | C | 92.8 | B |

TABLE 8

| Comp. Ex. No. | Two-Component Developer No. | Graininess: Initial Stage GIi (—) | Initial Stage Judgment | After Durable Printing GIa (—) | After Durable Printing ΔGI (—) | After Durable Printing Judgment | Toner-spent Transmittance (%) | Toner-spent Judgment |
|---|---|---|---|---|---|---|---|---|
| 11 | C11 | 0.163 | A | 0.181 | 0.018 | B | 87.2 | C |
| 12 | C12 | 0.164 | A | 0.185 | 0.021 | C | 86.2 | C |
| 13 | C13 | 0.178 | B | 0.199 | 0.021 | C | 88.1 | C |
| 14 | C14 | 0.180 | C | 0.192 | 0.012 | B | 94.1 | B |
| 15 | C15 | 0.168 | A | 0.188 | 0.020 | C | 88.8 | C |
| 16 | C16 | 0.174 | B | 0.195 | 0.021 | C | 91.1 | B |
| 17 | C17 | 0.177 | B | 0.208 | 0.031 | C | 89.7 | C |
| 18 | C18 | 0.181 | C | 0.195 | 0.014 | B | 87.3 | C |
| 19 | C19 | 0.182 | C | 0.193 | 0.011 | B | 93.1 | B |
| 20 | C20 | 0.182 | C | 0.194 | 0.012 | B | 94.2 | B |

As is obvious from Tables 1 to 8, all the two-component developers 1 to 22 can suppress the graininess of images sufficiently, and can suppress the occurrence of the toner-spent sufficiently. In contrast, all the two-component developers C1 to C20 are insufficient in at least one of the suppression of grainy feeling of images and the suppression of the occurrence of the toner-spent.

According to, for example, comparisons between the two-component developers 3 and C4, 10 and C10, 20 and C13, 1 and C3, 13 and C9, and 22 and C14; comparisons between the two-component developers 10, 12, 13 and C15 to C17; and comparisons between the two-component developers 20 to 22 and C18 to C20, it can be understood that, when the MDt ranges from 3.5 to 5.0 μm, and $4.5 \leq MDc/MDt \leq 6.5$ (Formula 1) is satisfied, the grainy feeling of images is sufficiently suppressed, and the occurrence of the toner-spent is sufficiently suppressed.

In addition to the condition, according to, for example, comparisons between the two-component developers 8, 19, 22 and C5, C6, C11; comparison between the two-component developers 20 and C1; and comparison between the two-component developers 19 and C12, it can be understood that, when the X ranges from 10 to 40, and $(2/5)X+Y \leq 20$ (Formula 2) is satisfied, the grainy feeling of images is sufficiently suppressed, and the occurrence of the toner-spent is sufficiently suppressed.

All the two-component developers 4, 7, 12 and 14, for example, among the two-component developers 1 to 22, are even more excellent in both the effect of suppressing grainy feeling of images and the effect of suppressing the occurrence of the toner-spent. Therefore, it can be understood that these effects are enhanced even more when the following Formulas 3 and 4 are also satisfied:

$$5.0 \leq MDc/MDt \leq 6.0 \quad \text{Formula 3}$$

$$(2/5)X+Y \leq 16 \text{ (with the proviso that } 14 \leq X \leq 35) \quad \text{Formula 4}$$

On the other hand, according to the two-component developers C15 to C20, when D50t is outside the range of from 3.5 to 45.0 μm, poor graininess of images tends to occur. The reason for the occurrence of poor graininess is considered as follows: the toner particles being too small or too large relative to the carrier particles cause the flow ability of the two-component developer to be insufficient, and in addition the toner particles being too small causes toner-spent to concur with the insufficient flow ability.

According to the two-component developers C3, C4, C9, C10, C13 and C14, when MDc/MDt is outside the range of from 4.5 to 6.5, toner-spent or the graininess of images tends to occur. The reason for the occurrence of toner-spent or the graininess of images is considered as follows: when MDc/MDt is too small, the contact points among toner particles and carrier particles are increased, whereas when MDc/MDt is too large, fierce collision of the carrier particles with the toner particles causes toner-spent to occur, thus leading to the lowering of flow ability of the two-component developer as well as the occurrence of uneven electric charge of the toner particles, and therefore one or both of the poor graininess of images and the toner-spent may occur.

According to the two-component developers C5 and C6, when (2/5)X+Y is more than 20, the toner-spent tends to occur. The occurrence of toner-spent is considered to be caused by a large number of fine carrier particles and spherical fine toner particles being likely to cause toner-spent.

According to the two-component developers C1, C2, C7, C8, C11 and C12, when X is outside the range from 10 to 40, the toner-spent or the poor graininess of images tends to occur. The reason for the occurrence of toner-spent or the graininess of images is considered as follows: when the relative ratio of the spherical fine toner particles to the fine carrier particles is too small or too large, the toner-spent due to the spherical fine toner particles or the lowering of the flow ability of the two-component developer occurs, and therefore one or both of the poor graininess of images and the toner-spent may occur.

INDUSTRIAL APPLICABILITY

According to the present invention, it is possible to form a high-quality image with toner particles having a small particle diameter, and to provide a two-component developer which suppresses the occurrence of toner-spent. Therefore, according to the present invention, more high-performance electrophotographic and energy-saving image forming apparatuses can be expected, as well as further spread of the image forming apparatuses can be expected.

REFERENCE SIGNS LIST

1 Image forming apparatus
30 Image processing section
40 Image forming section
41Y, 41M, 41C, 41K Image forming unit
42 Intermediate transfer unit
43 Secondary transfer unit
50 Sheet conveying section
51 Sheet feeding section
51*a*, 51*b*, 51*c* Sheet feeding tray unit
52 Sheet discharging section
52*a* Sheet discharging roller
53 Conveying path section
53*a* A pair of resist rollers
60 Fixing device
62 Fixing roller
63 Heat-generating belt
64 Pressure roller
110 Image reading section
111 Sheet feeder
112 Scanner
112*a* CCD sensor
411 Exposure device
412 Developing device
413 Photoconductor drum
414 Charging device
415 Drum cleaning device
421 Intermediate transfer belt
422 Primary transfer roller
423, 431 Support roller
423A Backup roller
426 Belt cleaning device
431A Secondary transfer roller
432 Secondary transfer belt
D Manuscript
S Sheet

What is claimed is:

1. A two-component developer for developing an electrostatic latent image, comprising toner particles and carrier particles, wherein a number-average particle diameter MDt of the toner particles ranges from 3.5 to 5.0 μm, and wherein the two-component developer satisfies the following Formulas 1 and 2:

$$4.5 \leq MDc/MDt \leq 6.5 \quad \text{Formula 1}$$

$$(2/5)X+Y \leq 20 \text{ (with the proviso that } 10 \leq X \leq 40) \quad \text{Formula 2}$$

where MDc represents a volume-average particle diameter of the carrier particles, X represents a proportion (%) of the toner particles having a number distribution-based particle diameter of 3.0 μm or more to less than 4.5 μm and a circularity of 0.980 or more in a total of the toner particles, and Y represents a proportion (%) of the carrier particles having a volume distribution-based particle diameter of (2/3)×MDc or less in a total of the carrier particles.

2. The two-component developer according to claim 1, wherein the two-component developer satisfies the following Formulas 3 and 4:

$$5.0 \leq MDc/MDt \leq 6.0 \quad \text{Formula 3}$$

$$(2/5)X+Y \leq 16 \text{ (with the proviso that } 14 \leq X \leq 35) \quad \text{Formula 4.}$$

3. The two-component developer according to claim 1, wherein the toner particles include toner base particles, and the toner base particles are toner base particles obtained by aggregating and fusing colorant particles and particles of a binder resin dispersed in an aqueous medium.

4. The two-component developer according to claim 3, wherein the binder resin includes a crystalline resin.

5. The two-component developer according to claim 1, wherein the toner particles further include an external additive, the external additive includes silica particles produced by a sol-gel method, and a number-average primary particle diameter of the silica particles is 70 to 200 nm.

6. The two-component developer according to claim 1, wherein the carrier particles each have a core material particle and a layer of a coating material that coats the surface of the core material particles, and the coating material includes a resin having a cycloalkyl group.

* * * * *